US005288072A

United States Patent [19]

Hsieh

[11] Patent Number: 5,288,072

[45] Date of Patent: Feb. 22, 1994

[54] HOCKEY PUCK

[76] Inventor: Wen-Sen Hsieh, No. 8-50, Lane 41, Been Street, Yan-Pyng Li, Dong-Shyh Chen Tair-Chung Shien, Taiwan

[21] Appl. No.: 21,792

[22] Filed: Feb. 24, 1993

[51] Int. Cl.[5] ..... A63B 71/00

[52] U.S. Cl. ..... 273/128 R

[58] Field of Search ..... 273/126 R, 126 A, 128 Q, 273/128 CS, 128 A, 57.2

[56] References Cited

U.S. PATENT DOCUMENTS

| | | | |
|---|---|---|---|
| 2,727,744 | 12/1955 | Watson | 273/128 R |
| 3,784,204 | 1/1974 | Felber | 273/128 R |
| 4,793,769 | 12/1988 | Dolan | 273/128 R |
| 4,801,144 | 1/1989 | DeMasi, Jr. et al. | 273/128 R |
| 5,149,096 | 9/1992 | Keating et al. | 273/128 R |
| 5,184,820 | 2/1993 | Keating et al. | 273/128 R |

*Primary Examiner*—Vincent Millin
*Assistant Examiner*—Raleigh W. Chiu
*Attorney, Agent, or Firm*—Pro-Techtor International

[57] ABSTRACT

A hockey puck of the type having a disk like main body which comprises a peripheral side surface substantially being of a cylindrical shape and comprises a top surface and a bottom surface all being flat, the hockey puck comprises the improvement of a plurality of bosses formed internally near the peripheral side surface and in an annular arrangement on each of the top and bottom surfaces, each of the bosses has a peak of small area. The puck is characterized in that the main body comprises two half main bodies made of hard material coupled with each other, and comprises a soft enveloping layer covering over the surfaces thereof but revealing only the bosses.

4 Claims, 2 Drawing Sheets

HOCKEY PUCK

BACKGROUND OF THE INVENTION

The present invention relates to a hockey puck, and especially to a hockey puck which suits various play grounds.

Conventional hockey pucks are used on an ice ground. The limitation of ground renders the hockey game not to be able of being popularized.

The conventional hockey pucks are designed and produced without regard to the wearing off problem, because the friction between an ice ground and a hockey puck is extremely small; therefore, the conventional hockey balls used in an ice ground are made of material not resistant to the wearing action. While if the pucks are used in other grounds such as grounds of earth, sand, or cement etc., the friction between the ball and the ground is larger, the pucks have to be made of material which is harder as well as more resistant to wearing. However, when a harder material is used, there will be the danger in case a hockey puck hits a game player to make a serious hurt.

SUMMARY OF THE INVENTION

The present invention is therefore considerated based on the purpose for popularizing the hockey puck, and provides a hockey puck which suits various play grounds.

The present invention provides a hockey puck which is made of a hard material but is enveloped with a soft material to reduce the possibility of damage to a minimum degree.

An object of the present invention is to provide a hockey puck suitable for various play grounds.

Another object of the present invention is to provide a hockey puck covered on its surface with a layer of soft material for diminishing the damage to people.

The hockey puck of the present invention includes two half main bodies made of hard material coupled with each other, the connecting portions of the two half main bodies have bending conformations complementary to each other, a concave portion is formed in the middle of each of the half main bodies, and a support is formed in the center of each of the concave portions; the sizes of these supports are selected so that these supports can be abutted against each other when these half main bodies are connected with each other. A plurality of bosses are provided at the peripheries on the top and bottom surfaces of each of the two half main bodies, each boss has a peak with a small area. The whole of these half main bodies is covered with a layer of soft material on the surfaces thereof when the bodies are connected with each other, and only the bosses are revealed.

The present invention will be apparent in reading the following detailed description thereof in referring to the accompanying drawings.

DETAILED DESCRIPTION OF THE PREFERRED EMBODIMENT

Figure 1:
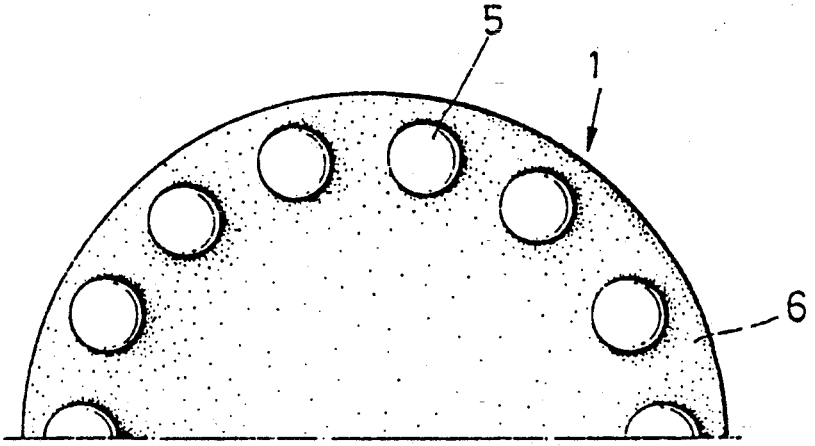
FIG. 1 is a top view of half of the hockey puck of the present invention.
Figure 2:
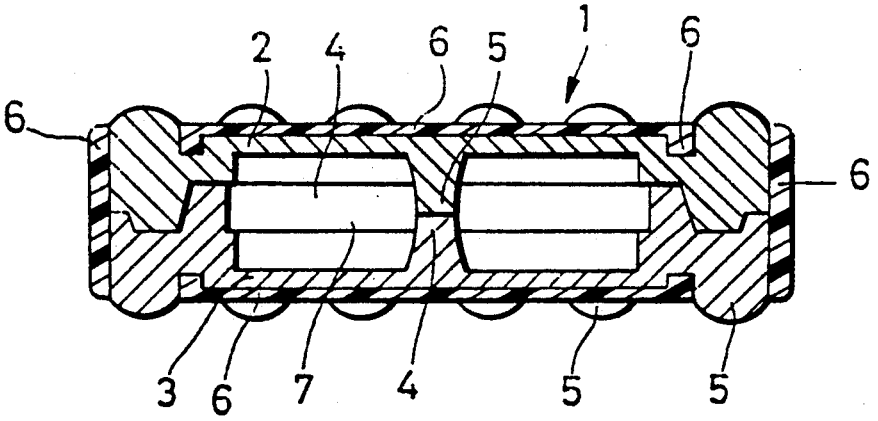
FIG. 2 is a sectional view taken from a sectional line extending diametrically in FIG. 1.

Referring to the drawings, a hockey puck 1 of the present invention comprises two half main bodies 2, 3 made of hard material coupled with each other, the connecting portions 9 of the two half main bodies 2, 3 have bending conformations complementary to each other, such as shown in FIG. 2. These bending conformations can on one hand render the two half main bodies 2, 3 to correctly join together in position, and can on the other hand have a function which will be narrated hereinafter. In the middle of each of the half main bodies 2, 3, there is formed with a concave portion 7, thus the material needed for the hockey puck 1 and the weight thereof can be reduced; a support 4 is formed at the center of each of the concave portions 7, the sizes of these supports 4 are selected so that these supports 4 can be abutted against each other when these half main bodies 2, 3 are connected with each other, in this way, the middle of the puck ball can be increased in stiffness and therefore can be prevented from being depressed.

A plurality of bosses 5 are provided at the peripheries on the top and bottom surfaces of each of the two half main bodies 2, 3, each boss 5 has a peak with a small area, so that when the hockey puck 1 slides on a ground, the hard peak of small area can contact with the ground. When these half main bodies 2, 3 is connected with each other, the outer surfaces thereof can be enveloped with a layer of soft material 6 by a conventional technique of overmolding, so that the damage of the hockey puck can be reduced to a minimun degree. These half main bodies 2, 3 can be in one colour, while the soft layer can be in another colour.

The further function of the bending conformations of the connecting portions 9 of the two half main bodies 2, 3 is the prevention ability against the permeation of the soft material into the space of the mid concave portions 7 through the half main bodies 2, 3 in the overmolding process.

Figure 3:
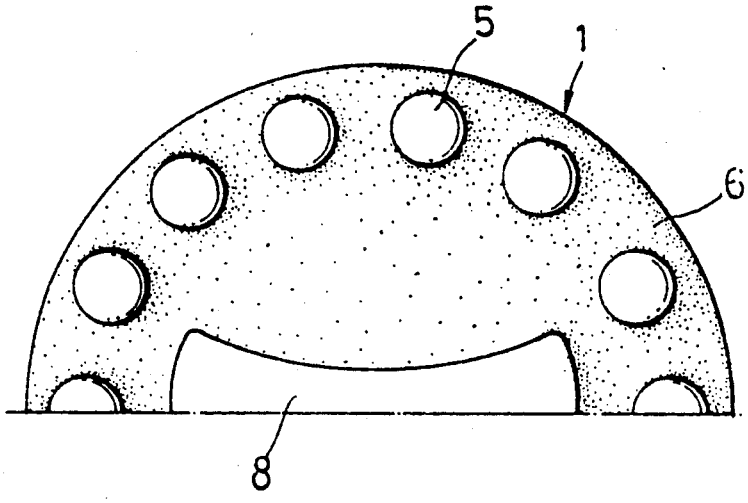
FIG. 3 is a top view similar to FIG. 1 showing another embodiment of the present invention.
Figure 4:
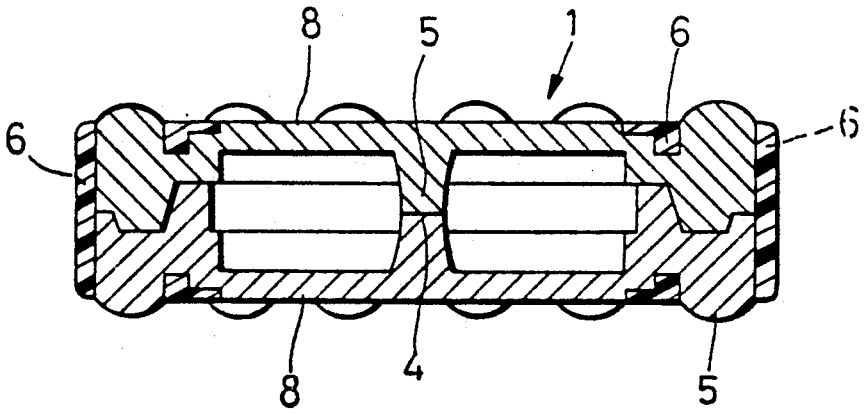
FIG. 4 is a sectional view of the modification of FIG. 3, similar to that of FIG. 2.

FIG. 3, 4 show a modification of the abovementioned embodiment of the present invention, wherein the middle portion 8 of hard material on the disk shaped hockey puck is revealed.

Having thus described my invention, what I claim as new and desire to be secured by Letters Patent is:

1. A hockey puck having a disk like main body which comprises a peripheral side surface substantially being of a cylindrical shape and comprises a top surface and a bottom surface all being flat, a plurality of bosses being formed internally near said peripheral side surface and in an annular arrangement on each of said top and bottom surfaces, each of said bosses having a peak of small area, said puck is characterized in that:

said main body comprises two half main bodies made of a hard material coupled with each other, and comprises a soft enveloping layer covering over said surfaces thereof but revealing only said bosses.

2. A hockey puck as stated in claim 1, wherein said two half main bodies made of hard material are different in colour from that of said soft enveloping layer.

3. A hockey puck as stated in claim 2, wherein said two half main bodies each has a mid concave portion, and at the center of each of said two half main bodies being a support, said supports can be abutted against each other when said half main bodies are connected with each other, so that the middle of said hockey puck can be increased in stiffness and therefore can be prevented from being depressed.

4. A hockey puck as stated in claim 3, wherein said two half main bodies have at the connecting portions thereof two bending conformations complementary to each other, when said half main bodies are connected with each other, said soft enveloping layer then covers said surfaces thereof.

* * * * *